US005836036A

United States Patent [19]

Ivory

[11] Patent Number: 5,836,036

[45] Date of Patent: Nov. 17, 1998

[54] SELF CLEANING TOOTHBRUSH

[76] Inventor: Brian Ivory, 38 S. Meridian Rd., Youngstown, Ohio 44509

[21] Appl. No.: 880,139

[22] Filed: Jun. 20, 1997

[51] Int. Cl.[6] ..... A46B 9/04

[52] U.S. Cl. ..... 15/167.1; 15/205.2

[58] Field of Search ..... 15/171, 167.1, 15/201, 159.1, 160, 205.2

[56] References Cited

U.S. PATENT DOCUMENTS

| | | | |
|---|---|---|---|
| D. 33,070 | 8/1900 | Hamilton | 15/159.1 |
| D. 282,318 | 1/1986 | Herzfeld . | |
| 300,422 | 9/1884 | White . | |
| 2,172,624 | 9/1939 | Romani | 15/167.1 |
| 2,438,268 | 3/1948 | Bressler . | |
| 2,582,552 | 1/1952 | Marco | 15/171 |
| 2,628,377 | 2/1953 | Cockriel | 15/167.1 |
| 2,676,350 | 4/1954 | Bressler | 15/167.1 |
| 2,730,747 | 1/1956 | Bressler | 15/201 |
| 4,423,531 | 1/1984 | Wall | 15/201 |
| 5,201,092 | 4/1993 | Colosn | 15/167.1 |
| 5,269,038 | 12/1993 | Bradley | 15/167.1 |

FOREIGN PATENT DOCUMENTS

| | | | |
|---|---|---|---|
| 810389 | 8/1951 | Germany | 15/160 |
| 9217093 | 10/1992 | WIPO | 15/167.1 |

*Primary Examiner*—Randall E. Chin
*Attorney, Agent, or Firm*—Harpman & Harpman

[57] ABSTRACT

A toothbrush that provides for improved cleaning after use by enhanced flow through the design. Brush bristles are positioned in spaced groups which are surrounded by open flow through areas that allows for a low surface area to opening ratio to ensure that each bristle group is thoroughly flushed with water during cleaning to dislodge used toothpaste.

9 Claims, 2 Drawing Sheets

SELF CLEANING TOOTHBRUSH

BACKGROUND OF THE INVENTION

1. Technical Field

This device relates to toothbrushes that are used by humans to clean their teeth by manipulating same to mechanically scrub the teeth with toothpaste or other cleaning agents.

2. Description of Prior Art

Prior art devices of this type are directed to toothbrushes that have improved cleaning operation to allow for better brush cleaning after use and improved performance during use, see for example U.S. Pat. Nos. 300,422, 2,438,268 and Des. 282,318.

In U.S. Pat. No. 300,422 a toothbrush is disclosed and claimed having a modified brush head wherein a number of small funnel like openings are provided within the brush head with outlets being between the rows of embedded bristles typically found in standard toothbrushes.

U.S. Pat. No. 2,438,268 is directed to a flexible bristle head toothbrush wherein a plurality of independent brush bristle support sections are secured together in parallel spaced relation to one another by a flexible connector element that extends through oppositely disposed portions of each section and attaches to a handle.

Finally, in design patent Des. 282,318 a toothbrush head design is disclosed wherein a brush head has a single large opening therein surrounded by a plurality of bristles extending therefrom.

SUMMARY OF THE INVENTION

A self cleaning toothbrush that has a plurality of brush bristle groups that are mounted in spaced relation to one another on a lattice-like brush head support. The lattice support base allows water to pass freely through the brush head about each of the bristle groups cleaning same. A perimeter support band interconnects the lattice support defining an integral brush head having a greater open area than brush bristle support ratio.

DESCRIPTION OF THE PREFERRED EMBODIMENT

Figure 1:
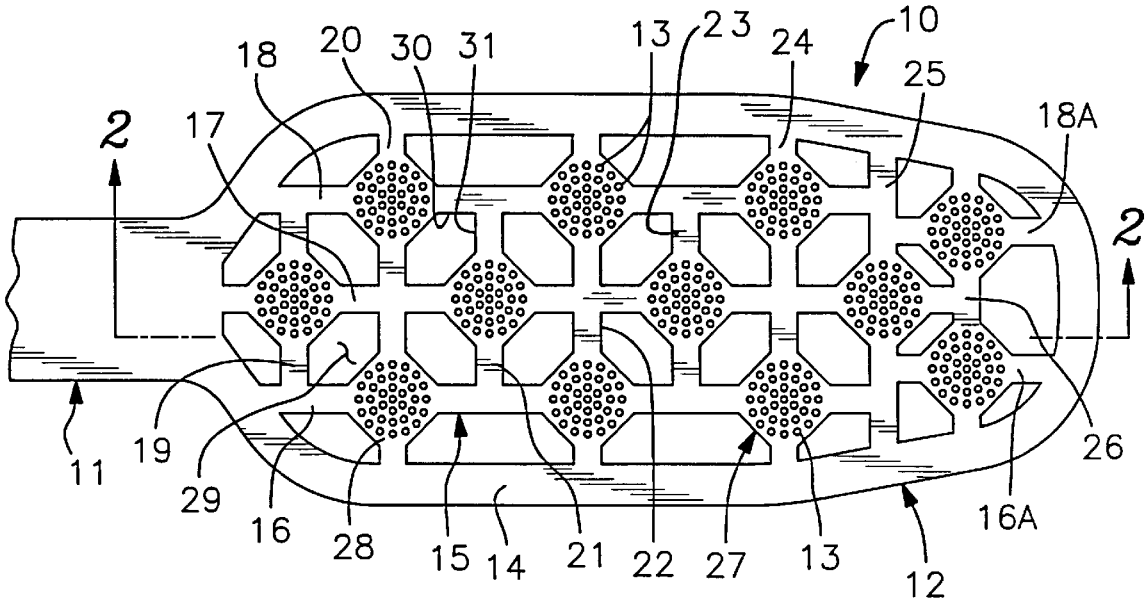
FIG. 1 is an enlarged bottom plan view of the brush head portion of the invention.
Figure 2:
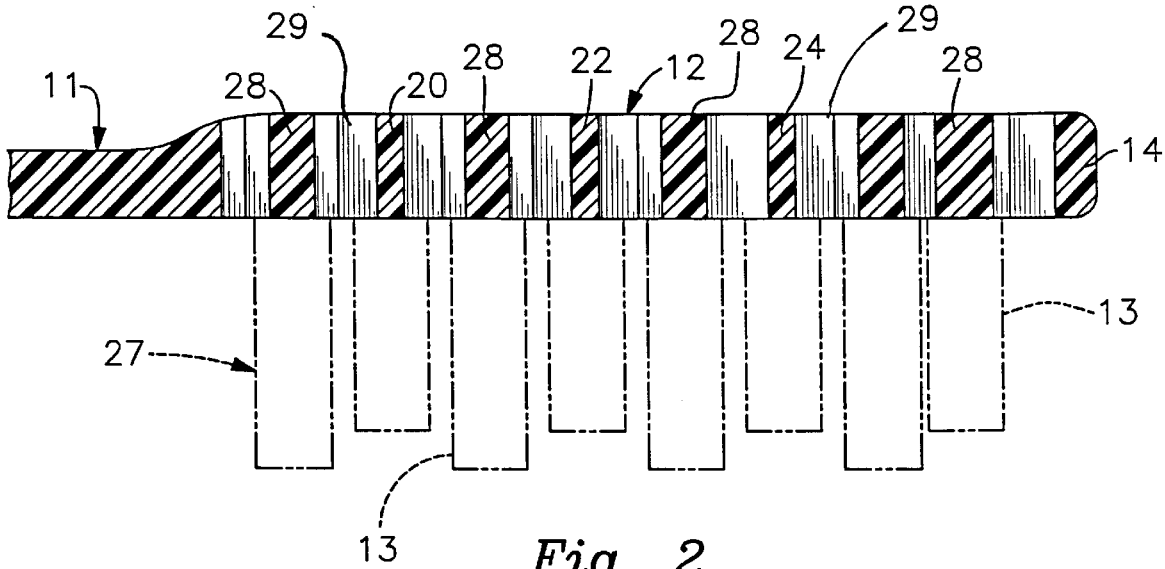
FIG. 2 is an enlarged cross-sectional view on lines 2—2 of FIG. 1.
Figure 3:
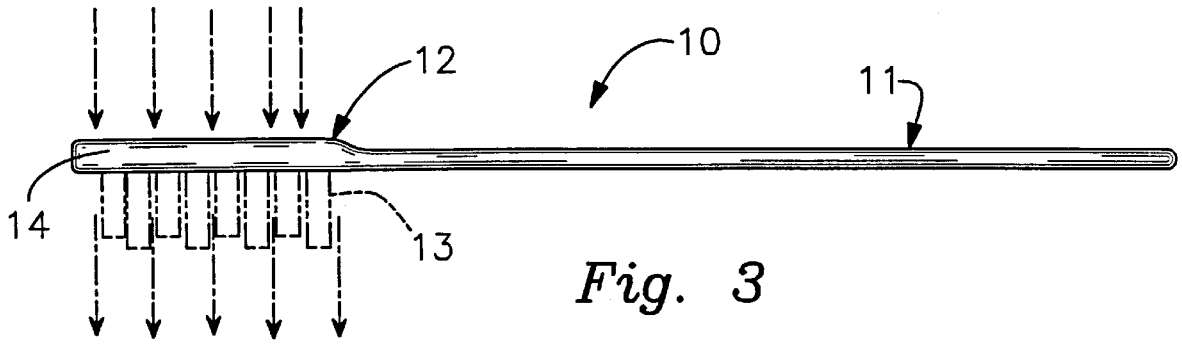
FIG. 3 is an enlarged side elevational view of the toothbrush of the invention illustrating the flow-through properties during cleaning as indicated by directional flow arrows.

Referring to FIG. 3 of the drawing, a self-cleaning toothbrush 10 is illustrated with a handle portion 11, and a brush portion 12 having a plurality of brush bristles 13 indicated by broken lines extending therefrom. The brush head 12, best seen in FIGS. 1, 2 and 3 of the drawings has an outer perimeter support portion 14 that defines a generally rectangular shape of the brush head portion 12. A series of intersecting support rails extend between oppositely disposed sections of the perimeter support portion 14 defining a grid pattern thereon. The intersecting support rails are arranged into longitudinally extending elements 16, 17, and 18 and transversely extending cross support elements 19 through 26 as best seen in FIG. 1 of the drawings. The longitudinal extending elements 16 and 18 have offset distal end portions 16A and 18A respectively that intersect transverse element 26. Accordingly, elements 16–18 join transverse element 25 at respective points of angular offset intersections. The plurality of brush bristles 13 are arranged in bristle bunches 27 and are secured within enlarged mounting areas 28 that are formed at the intersection point of the hereinbefore described support rails. The bristles 13 are partially embedded within the mounting areas 28 by traditional brush manufacturing techniques, well known and understood by those skilled in the art.

In this example chosen for illustration, each of the longitudinally extending elements 16, 17, and 18 have four of the mounting areas 28 therealong. The mounting areas 28 and corresponding attached bristle bunches 27 are in staggered relation to one another between the corresponding longitudinally extending elements 16, 17, and 18 as best seen in FIG. 1 of the drawings.

Each of the respective support rails 15 and associated mounting areas 28 are of an equal dimensional depth as that of the surrounding perimeter support portion 14 and in combination therewith forms the bristle head portion 12 as hereinbefore described.

Referring now to FIG. 2 of the drawings, the open pass through nature of the brush head portion 12 is illustrated and defined by open areas 29 between the support rails 15 and around the mounting areas 28. The open areas 29 are overall greater than that of the correspondingly depending bristle bunches 27 thus assuring superior cleaning action when placed under running tap water as generally illustrated by directional arrows in FIG. 3 of the drawings.

In the embodiment chosen for illustration as hereinbefore described, it will be noted that the length of the bristle bunches 27 can vary as illustrated in FIG. 2 of the drawings as is typical in toothbrush designs to afford maximum teeth cleaning action, not shown.

Referring back to FIG. 1 of the drawings, it will further be seen that open areas 29 defined by the intersecting support rails 15 have oppositely disposed abutting angular wall pairs 30 and 31 and that the corresponding mounting areas 28 that help define each of the open areas 29 create an enhance flow action of tap water as it passes therethrough enveloping the aforementioned bristle bunches within the water flow by design, see FIG. 3 of the drawings as indicated by directional flow arrows.

Finally, it will be apparent that the open areas 29 adjacent the perimeter support portion 14 define a segmented water flow pattern about the bristle bunches during cleaning.

Figure 4:
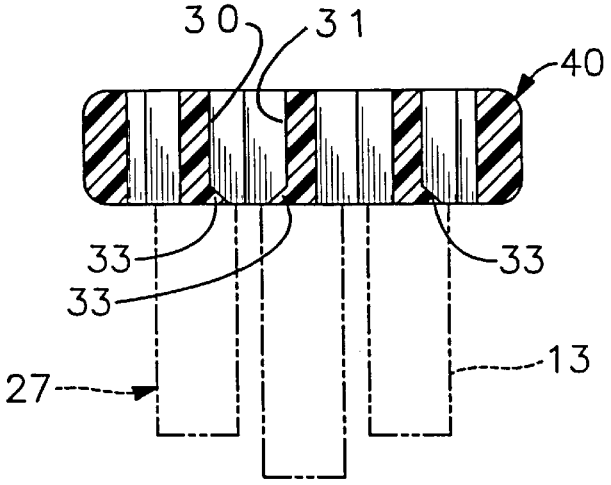
FIG. 4 is an enlarged cross-sectional view of an alternate form of the invention having enhanced water distribution features.

Referring now to FIG. 4 of the drawings, an alternate form of the invention 40 can be seen wherein a plurality of flow diverters 33 extend from some of said abutting angular walls 30 and 31. The flow diverters 33 extend into the open areas 29 impinging and diverting a portion of the water flow path against adjacent bristle bunches 27 shown in broken the self cleaning toothbrush of the invention is preferably made of synthetic resin material for ease of construction and durability lines.

It will thus be seen that a new and novel toothbrush has been illustrated and described and that it will be apparent to those skilled in the art that various changes and modifications may be made therein without departing from the spirit of the invention.

Therefore I claim:

1. A toothbrush having a handle portion and a brush head portion, said brush head portion comprising;

a plurality of longitudinally and transversely spaced intersecting support rails, said support rails are of a known transverse dimension intersecting support rails define bristle mounting areas of a greater transverse dimension than that of said support rails said bristle mounting areas are in staggered relation to one another, a plurality of toothbrush bristles extending from said respective mounting areas and said handle portion extending from said brush head portion.

2. The toothbrush set forth in claim 1 wherein said interconnected support rails intersect at right angles to one another.

3. The toothbrush set forth in claim 1 wherein said bristle mounting areas have angular self-effacing walled surface areas.

4. The toothbrush set forth in claim 1 wherein a perimeter support portion of said support rails define said brush head.

5. The toothbrush set forth in claim 1 wherein said toothbrush bristles are of unequal length in relation to one another.

6. The toothbrush set forth in claim 1 wherein said handle portion and said brush head portion are molded of synthetic resin material.

7. A toothbrush comprising; a handle portion having a brush head portion, a plurality of interconnected intersecting support rails within said brush head portion, enlarged bristle mounting areas defined at the intersections of said support rails, a plurality of brush bristles extending from said bristle mounting areas, a perimeter rail enclosing said interconnected intersecting support rails defining said brush head, said intersecting support rails and said enlarged bristle mounting areas define open areas therebetween surrounding said bristle mounting areas, flow diverters extending from said support rails opposing said bristle mounting areas.

8. The toothbrush set forth in claim 7 wherein said bristle mounting areas are in angular offset relation to one another.

9. The toothbrush set forth in claim 7 wherein said handle portion and said brush head portion are made of synthetic resin material.

* * * * *